US009966246B2

(12) United States Patent
Schoenfelder et al.

(10) Patent No.: US 9,966,246 B2
(45) Date of Patent: May 8, 2018

(54) DOUBLE-FILAMENT INCANDESCENT LAMP FOR AUTOMOTIVE VEHICLE FRONT LIGHTING

(71) Applicant: KONINKLIJKE PHILIPS N.V., Eindhoven (NL)

(72) Inventors: Bernd Schoenfelder, Eindhoven (NL); Johannes Gerhard Moeller, Eindhoven (NL)

(73) Assignee: Koninklijke Philips N.V., Eind (NL)

( * ) Notice: Subject to any disclaimer, the term of this patent is extended or adjusted under 35 U.S.C. 154(b) by 280 days.

(21) Appl. No.: 14/891,316

(22) PCT Filed: Apr. 30, 2014

(86) PCT No.: PCT/EP2014/058779

§ 371 (c)(1),
(2) Date: Nov. 13, 2015

(87) PCT Pub. No.: WO2014/183996

PCT Pub. Date: Nov. 20, 2014

(65) Prior Publication Data

US 2016/0099142 A1 Apr. 7, 2016

(30) Foreign Application Priority Data

May 13, 2013 (EP) ..... 13167462

(51) Int. Cl.
*H01K 1/26* (2006.01)
*H01K 1/02* (2006.01)
(Continued)

(52) U.S. Cl.
CPC ..... *H01K 1/26* (2013.01); *F21S 41/164* (2018.01); *H01K 1/02* (2013.01); *H01K 1/50* (2013.01); *H01K 9/08* (2013.01)

(58) Field of Classification Search
CPC .. H01K 1/26; H01K 1/50; H01K 1/02; H01K 9/08; F21S 48/1172
See application file for complete search history.

(56) References Cited

U.S. PATENT DOCUMENTS 5,578,893 A 11/1996 Yamamoto
5,857,764 A 1/1999 Tabata et al.
(Continued)

FOREIGN PATENT DOCUMENTS

CN 198512 A 6/2007
DE 102008009204 A1 8/2009
(Continued)

OTHER PUBLICATIONS

United Nations Economic Commission for Europe, "Uniform Provisions Concerning the Approval of Filament Lamps for Use in Approved Lamp Units on Power-Driven Vehicles and of their Trailers", Regulation, Oct. 26 2005, Addendum 36: Regulation No. 37, Revision 4, 162 pages.*
(Continued)

*Primary Examiner* — David V Bruce

(57) ABSTRACT

A lamp for automotive vehicle front lighting is described. The lamp 10 comprises a base 12 for mechanical and electrical connection to an automotive headlight 50 and a burner 14 fixed to the base 12. The burner 14 comprises an enclosed transparent vessel 22. A first and a second filament 34, 36 are arranged within the vessel 22. A baffle 40 is arranged proximate to the first filament 34 to shield the second filament 36 from the first filament 34. When the first filament 34 is operated at a supply voltage of 13.2 V at an electrical power greater than 35 W and less than or equal to 38 W, light with a luminous flux of 500-700 lm is emitted from the lamp 10. If the second filament 36 is operated at a supply voltage of 13.2 V at an electrical power greater than 35 W and less than or equal to 38 W, light with a luminous
(Continued)

flux of 800-1,000 lm is emitted from the lamp 10. Both the first and the second filament wire 34, 36 are comprised of a filament wire wound in a winding structure around a filament axis, where the number of winding turns for each of first and second filaments 34, 36 is 16-23.

10 Claims, 2 Drawing Sheets

(51) Int. Cl.
*H01K 9/08* (2006.01)
*H01K 1/50* (2006.01)

(56) References Cited

U.S. PATENT DOCUMENTS

| | | | |
|---|---|---|---|
| 8,907,563 | B2 | 12/2014 | Kaps et al. |
| 2007/0008720 | A1 | 1/2007 | Van Rijswick et al. |
| 2012/0146495 | A1 | 6/2012 | Hoffmann et al. |

FOREIGN PATENT DOCUMENTS

| | | | |
|---|---|---|---|
| DE | 10-2009-054936 | A1 | 6/2011 |
| DE | 102011004290 | A1 | 8/2012 |
| WO | 2008-055943 | A2 | 5/2008 |

OTHER PUBLICATIONS

Second Office Action dated Mar. 13, 2017, China Patent Application No. 201480027646.7, 20 pages.
EPO as ISA, PCT/EP2014/058779, filed Apr. 30, 2014, "International Search Report and Written Opinion" dated Jun. 20, 2014, 12 pages.
EPO, 13167462.4, "Extended European Search Report", 7 pages.
United Nations Economic Commission for Europe, "Uniform Provisions Concerning the Approval of Filament Lamps for Use in Approved Lamp Units on Power-Driven Vehicles and of their Trailers", Regulation, Oct. 26, 2005, Addendum 36: Regulation No. 37, Revision 4, 162 pages.
First Office Action dated Aug. 1, 2016, China Patent Application No. 201480027646.7, 26 pages.
Third Office Action dated Jun. 19, 2017, China Patent Application No. 201480027646.7, 8 pages.

* cited by examiner

DOUBLE-FILAMENT INCANDESCENT LAMP FOR AUTOMOTIVE VEHICLE FRONT LIGHTING

CROSS-REFERENCE TO RELATED APPLICATIONS

The present application is a § 371 application of International Application No. PCT/EP2014/058779 filed on Apr. 30, 2014 and entitled "Double-filament incandescent lamp for automotive vehicle front lighting," which claims the benefit of EP Application No. 13167462.4, filed on May 13, 2013.

FIELD OF THE INVENTION

The invention relates to an electrical lamp, and in particular to a lamp for use in automotive vehicle front lighting. The invention further relates to a vehicle headlight.

BACKGROUND OF THE INVENTION

Automotive headlights, i.e. headlights for use on board of a vehicle, such as e.g. a car, motorcycle, truck or other type of vehicle generally comprise a reflector and, mounted therein, a lamp. Known incandescent lamps, in particular halogen lamps, generally comprise a base and a burner. The base provides mechanical and electrical connection to the automotive headlight, whereas the burner comprises the actual light-emitting element, in particular filament. Light emitted from the filament is reflected by the reflector to form a beam for illumination in front of the vehicle.

Different types of incandescent lamps are known, which comprise one or more filaments arranged within a vessel.

DE 10 2011 004 290 discloses a halogen incandescent lamp for automotive frontlights. Within a vessel, a filament is arranged which is dimensioned such that operation at an operating voltage of 13.2 V operation and at an electrical power of 22-27 W leads to a luminous flux of 400-600 Lumen (lm). The lamp comprises a single filament with 17-23 windings, a length of 2.1-3.6 mm and an outer diameter of the winding of 0.9-1.3 mm. The filament wire has a diameter of 95-105 μm. The interior of the vessel is filled with a filling gas of a halogen and a rare gas at a cold filling pressure of 0.7-1.5 Mpa.

US 2007/0008720 A1 relates to a lamp-reflector unit with a first and second light source axially disposed on the lamp axis. A low-voltage halogen incandescent lamp is fixed in the neck of a reflector with cement. A first filament has a rated power of 35 W and a second filament a rated power of 50 W. The first filament generates a narrow light beam and the second filament a wide light beam during lamp operation. If simultaneously operated, a circular symmetrical light beam of high luminous intensity is obtained.

WO 2008/055943 A2 describes a halogen bulb comprising two filaments located in a lamp body. The first filament is partially enclosed by a baffle and has a nominal voltage of 13.2 V or 28 V and electrical power of 55-80 W. In different embodiments, the first filament has 17.5 or 15.5 windings. The second filament has a nominal voltage of 13.2 V or 28 V and electrical power of 17-22 W. In different embodiments, the second filament has 27 or 28 windings.

Revision 4 of UNECE Regulation No. 37 of 26.10.2005 regulates automotive front lighting lamps of category HS1. These lamps are double-filament lamps with a low-beam filament shielded by a baffle and an unshielded high-beam filament and with the baffle partly extending in between the two filaments. The Regulation determines that the two filaments, being supplied with a test voltage of 13.2 V, ideally should operate each at an electrical power of 35 W and should emit a luminous flux of 525 lm for the low-beam and 825 lm for the high-beam filament.

It is an object to propose a lamp with a filament arrangement well suited for automotive front lighting application.

SUMMARY OF THE INVENTION

According to an aspect of the invention, a lamp according to claim 1 and a vehicle headlight according to claim 11 are proposed. Dependent claims refer to preferred embodiments.

A lamp according to an aspect of the invention comprises a base for mechanical and electrical connection to an automotive headlight. Electrical contacts may protrude out of the base, in particular from the rear thereof. The base further preferably comprises a positioning ring which serves for mounting the lamp in a reflector of a vehicle headlight in a defined position and orientation. A lamp axis may be defined as the longitudinal axis through the center of the positioning ring. The positioning ring may comprise radial protrusions, which may serve for mechanical fixing, and for exact positioning. It is in particular preferred to provide one reference protrusion to define a radial reference direction R.

The lamp further comprises a burner with a sealed vessel, at least partially transparent, preferably of glass. According to the invention, at least a first and a second filament are arranged within the vessel, provided at a distance from each other. Preferably, the filaments are spaced along the longitudinal axis of the lamp, i.e. the axis extending centrally through the e.g. cylinder-shaped vessel.

According to one aspect, a baffle is arranged proximate to a first filament. As will become apparent in connection with preferred embodiments, the baffle may in particular be arranged to cover the axial range of the first filament, i.e. be arranged in radial directions of the first filament along the whole axial length thereof. Thus, a portion of the light emitted from the first filament, emitted into spatial directions of the proximate baffle, will be shaded by the baffle.

Further, the baffle may be arranged to shield the first filament from a second filament, i.e. be arranged at least partially in between the filaments. The baffle thus serves to separate angular ranges illuminated by both filaments from angular ranges illuminated only by the second filament, where light emitted from the first filament is shaded at the baffle. Corresponding portions of the reflector may be shaped to reflect light emitted from the first filament—which may be denoted a low beam filament—into a first beam (low beam, comprising a bright/dark cutoff) and correspondingly reflect light emitted from the second filament (e. g. high-beam filament) into a reflected beam (high beam) without a bright/dark cutoff.

Each of the first and second filament are configured to operate if supplied with a voltage of 13.2 V at an electrical power in the range of 35-38 W.

However, the resulting light output of the lamp differs for the two filaments: If only the first filament is operated at the above indicated voltage and power, the lamp emits light with a luminous flux of 500-700 lm. If only the second filament is operated at the above indicated voltage and power, the lamp emits light with a luminous flux of 800-1,000 lm. These differences in light output are due to partial shading, e.g. at the baffle and optionally at an opaque covering at the tip of the vessel.

According to an aspect of the invention, each of the first and second filament are comprised of a filament wire wound around a filament axis. The filament wire is preferably wound in a single winding structure. The filament axes of both filaments are preferably straight and arranged in parallel, further preferred are arranged in parallel to the longitudinal axis. According to one aspect, the number of winding turns of filament wire for each of the first and second filament is 16-23 windings. Further preferred are 18-22 windings for both filaments.

A lamp according to one or more of the above aspects of the invention may flexibly be used for purposes of automotive front lighting.

In preferred embodiments, the diameter of the filament wire may be 115-130 μm. The length of the winding structure along the filament axis may be 3.6-4.8 mm. An outer diameter of the winding structure for each of the first and second filament may be 0.8-1.2 mm.

According to one embodiment, the vessel may be filled with a filling gas comprising at least halogen and one noble gas or a mixture of gases. In particular, the noble gas/mixture may comprise a gas chosen out of the group comprising xenon, crypton and argon. Halogen may be bromide and/or chloride. The filling gas may be provided within the vessel with a cold filling pressure of 0.4-1.2 Mpa.

According to a preferred embodiment of the invention, the vessel comprises a circular cylindrical portion surrounding the filaments. The circular cylindrical portion of the vessel may have an outer diameter of 8-16 mm.

According to a further preferred embodiment, there may be arranged at least three holding wires within the vessel. The filaments may be fixed to the holding wires. Also, the baffle may be fixed to one of the holding wires. It is preferred to have the holding wires extending from a pinch seal of the vessel, projecting into the interior of the vessel. In one embodiment, a holding bar is arranged distant from the pinch seal. The holding bar may enclose the holding wires to provide mechanical fixing thereof.

In one embodiment, the base comprises three electrical contacts, and three holding wires are arranged extending from a pinch seal of the vessel into the interior thereof. Each of the holding wires is electrically connected to one of the electrical contacts. The first filament may be electrically connected between the first and third holding wire, and the second filament may be electrically connected between a second and the third holding wire. Thus, the filaments share a common electrical connection.

According to a preferred embodiment of the invention, a reference protrusion may be provided at the base. The reference protrusion may protrude radially. A symmetry plane may be defined by the reference protrusion. Preferably, the symmetry plane is arranged to include the longitudinal axis of the lamp and is oriented radially towards the reference protrusion.

According to a preferred aspect, at least the arrangement of the filaments and of the baffle may be symmetrical to the thus defined symmetry plane. This will create a symmetrical beam pattern. In the case of a beam pattern with a bright/dark cutoff, the bright/dark cutoff will be arranged horizontally.

According to a further aspect, a vehicle headlight with a reflector may be equipped with a lamp according to one of the above aspects. In particular, the vehicle headlamp may be a motorcycle headlamp.

These and other aspects of the invention will become apparent from and elucidated with reference to the embodiment described hereinafter.

BRIEF DESCRIPTION OF THE DRAWINGS

In the drawings FIG. 1 show a perspective view of a lamp according to an embodiment of the invention.

DETAILED DESCRIPTION OF EMBODIMENTS

Figure 1:
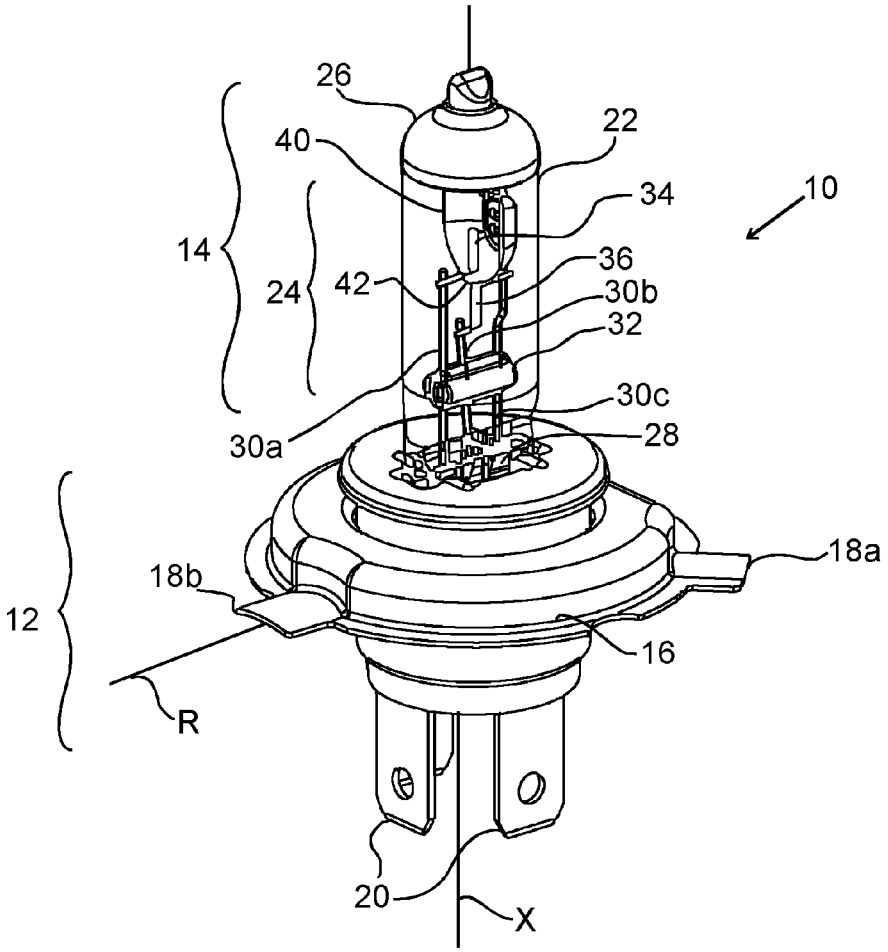

FIG. 1 shows an automotive halogen lamp 10 in a perspective view.

The lamp 10 comprises a base 12 and a burner 14 fixed to the base 12.

The base 12 comprises a positioning ring 16 which includes three positioning protrusions 18*a*, 18*b* radially protruding from the base 12 (of which only two are shown in FIG. 1). A reference plane for the mounting position of the lamp 10 in a reflector (FIG. 3) may be defined by the upper portions of the three positioning protrusions. A lamp axis X may be defined as longitudinal axis of the lamp 10 perpendicular to this reference plane through the center of the positioning ring 16.

Figure 3:
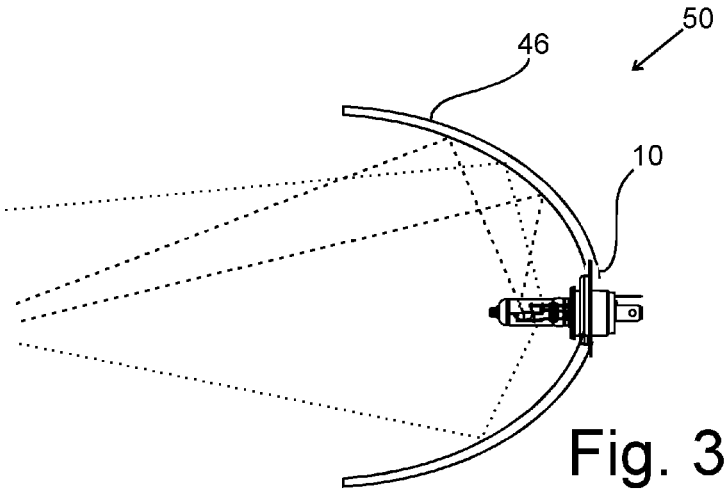
FIG. 3 shows in a schematic representation a vehicle headlight with a lamp according to FIG. 1.

The lamp 10 may be fixed to a vehicle headlight so as shown in FIG. 3 where the protrusions 18*a*, 18*b* provide exact positioning. The protrusion 18*b* serves as a reference protrusion defining a radial reference direction R. A symmetry plane is positioned to include the lamp axis X and the reference direction R extending radially from the longitudinal axis X into the direction of the center of the reference protrusion 18*b*.

The burner 14 comprises a glass vessel 22 with a central portion 24 of circular cylindrical shape. At the top, the otherwise transparent vessel 22 comprises a coated portion 26 which is opaque. At the bottom, the vessel 22 is sealed in a pinch seal 28, which is fixed to the base 12.

Projecting from the pinch seal 28 into the interior of the vessel 22 are three holding wires 30*a*, 30*b*, 30*c*. The holding wires 30*a*, 30*b*, 30*c* are further fixed by a holding bar 32 arranged distant from the pinch seal 28. Further, fixed to the holding wires 30*a*, 30*b*, 30*c* are arranged a first filament 34 (low-beam filament) and a second filament 36 (high-beam filament).

Proximate to the first filament 34 a baffle 40 is arranged. As shown, the baffle is provided to cover the axial extent of the first filament 34 and thus partially shield light emitted from the filament 34 into radial directions. Further, a front portion 42 of the baffle 40 is arranged in between the first and second filaments 34, 36 and therefore serves to shield the filaments 34, 36 from one another.

Figure 2:
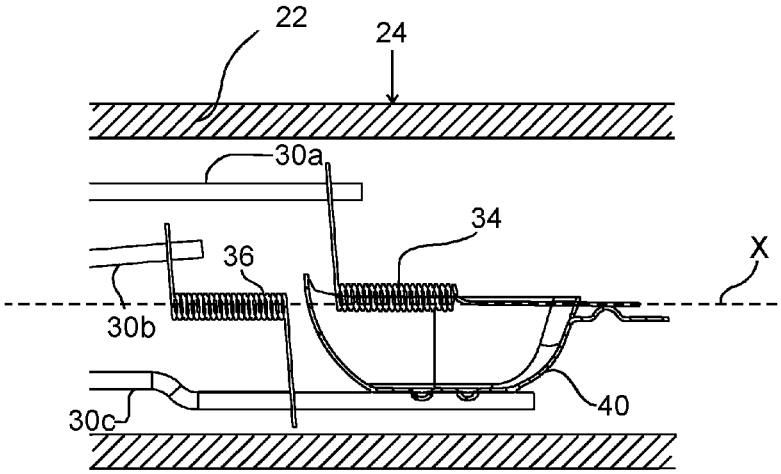
FIG. 2 shows an enlarged sectional view of a portion of the lamp of FIG. 1 with the section taken along line R.

As shown in detail in the enlarged sectional view of FIG. 2, the first, low beam filament 34 is connected at one end to a first holding wire 30*a* and at the other end to the baffle 40, which is fixed to the third holding wire 30*c*. The second high-beam filament 36 is fixed to a second holding wire 30*b* and to the third holding wire 30*c*. By these connections, the filaments 34, 36 are both mechanically held at defined positions within the vessel 22 and are electrically connected to the holding wires 30*a*, 30*b*, 30*c*. The holding wires, in turn, are connected internally within the base 12 to electrical contacts 20 protruding from the lower portion of the base 12. Thus, the filaments 34, 36 are operated by supplying electrical power to the electrical contacts 20.

FIG. 2 shows a sectional view of the central, circular-cylindrical portion 24 of the vessel 22. As shown, the filaments 34, 36 are each provided as a single winding structure of filament wire wound around a straight filament axis. Both filament axes are parallel to the longitudinal axis X of the lamp 10.

The circular cylindrical portion 24 of the vessel 22 surrounding the filaments 34, 36 has an outer diameter of 12.8 mm.

In the preferred embodiment, the filament wire used for the first filament 34 comprises tungsten, and may in particular be potassium doped tungsten. The wire in the example has a diameter of 122 μm, wound in 20 winding turns. The outer diameter of the winding structure of the first filament 34 is 1.0 mm and the length of the winding structure is 4.2 mm.

The second filament 36 has the same winding structure as the first filament 34, i.e. a single winding structure around the straight filament axis. The filament wire out of potassium doped tungsten with a diameter of 119 μm is wound in 20 winding turns of an outer diameter of 1.0 mm along a length of 4.0 mm.

The interior of the sealed vessel 22 is filled with a filling gas. In the preferred embodiment, the filling gas is a mixture of xenon and crypton provided at a cold filling pressure of 1 Mpa. Further, a certain quantity of a halogen, chlorides and bromides, is enclosed within the vessel 22.

In operation of the lamp 10, if a nominal voltage of 13.2 V is applied to either the first filament 34 or the second filament 36, i.e. the first holding wire 30*a* and the third holding wire 30*c*, and between the second holding wire 30*b* and the third holding wire 30*c*, the first and the second filament 34, 36 each operate at an electrical power of 36-36.5 W. In operation of the first filament, the lamp emits a luminous flux of 580 lm, and in operation of the second filament 36 emits a luminous flux of 875 lm, due to partial shading at the baffle 40 and the coated portion 26.

FIG. 3 shows schematically a headlight 50 where the lamp 10 as described above is schematically shown arranged within a reflector 46. Light emitted from the filaments 34, 36 (not shown in FIG. 3) is reflected by the reflector 46 to form different illumination beams. Light from the second (high-beam) filament 36 is reflected by both the upper and lower part of the reflector 46 to form a high-beam without a bright/dark cutoff.

Light emitted from the first low-beam filament 34 is partially shielded by the baffle 40 such that only an upper portion of the reflector 46 is illuminated. The upper portion of reflector 46 is shaped to reflect the light from the first filament 34 to form an illumination beam with a bright/dark cutoff.

Arrangement of the filaments 34, 36 and of the baffle 40 is exactly symmetrical with regard to the symmetry plane defined by the axes R, X. Thus, the resulting beam patterns are symmetrical, too. In particular, the low-beam pattern will have a horizontal bright/dark cutoff.

While the invention has been illustrated and described in detail in the drawings and foregoing description, such illustration and description are to be considered illustrative or exemplary and not restrictive; the invention is not limited to the disclosed embodiment.

Variations from the disclosed embodiments can be understood and effected by those skilled in the art in practicing the claimed invention, from a study of the drawings, the disclosure and the appended claims. In the claims the word "comprising" does not exclude other elements, and the indefinite articles "a" or "an" do not exclude a plurality.

The mere fact that certain measures are recited in mutually different dependent claims does not indicate that a combination of these measures cannot be used to advantage. Any reference signs in the claims should not be construed as limiting the scope.

The invention claimed is:

1. Lamp for automotive vehicle front lighting, comprising
a base for mechanical and electrical connection to an automotive headlight,
a burner fixed to said base, said burner comprising a sealed transparent vessel,
at least a first and a second filament arranged within said vessel,
a baffle arranged proximate to said first filament to shield said second filament from said first filament,
where when said first filament is supplied with a supply voltage of 13.2 V it is operated at an electrical power greater than 35 W and less than or equal to 38 W, and light with a luminous flux of 500-700 lm is emitted,
and where when said second filament is supplied with a supply voltage of 13.2 V it is operated at an electrical power greater than 35 W and less than or equal to 38 W, and light with a luminous flux of 800-1,000 lm is emitted,
wherein each of said first and second filaments are comprised of a filament wire wound around a filament axis,
where the number of winding turns for each of said first and second filaments is 16-23,
wherein said base comprises a reference protrusion defining a symmetry plane (X, R), the symmetry plane including a longitudinal axis (X) of the lamp and a reference direction (R) extending radially from the longitudinal axis (X) into a direction of a center of the reference protrusion,
where said filaments and said baffle are arranged symmetrical to said symmetry plane (X, R).

2. Lamp according to claim 1, wherein
the diameter of said filament wire of said first and second filaments is 115-130 μm.

3. Lamp according to claim 1, wherein
the length of said first and second filaments along said filament axes is 3.6-4.8 mm.

4. Lamp according to claim 1, wherein
an outer diameter of said first and second filaments is 0.8-1.2 mm.

5. Lamp according to claim 1, wherein
said vessel is filled with a filling gas, said filling gas comprising at least one noble gas selected from the group consisting of xenon, krypton, and argon,
said filling gas being provided within said vessel with a cold filling pressure of 0.4-1.2 Mpa.

6. Lamp according to claim 5, wherein
said filling comprises an amount of halogen comprising at least chlorides and/or bromides.

7. Lamp according to claim 1, wherein
said vessel comprises a circular cylindrical portion surrounding said filaments,
where at said circular cylindrical portion said vessel has an outer diameter of 8-16 mm.

8. Lamp according to claim 1, wherein
at least three holding wires are arranged within said vessel,
and said filaments and said baffle are fixed to said holding wires,
where said holding wires extend from a pinch seal of said vessel into the interior of said vessel,
and where a holding bar is arranged distant from said pinch seal, said holding bar enclosing said holding wires.

9. Lamp according to one claim 1, wherein said base comprises three electrical contacts, and three holding wires are arranged extending from a pinch seal of said vessel into the interior of said vessel, each of said holding wires being electrically connected to one of said electrical contacts, where said first filament is electrically connected between a first and a third holding wire, and where said second filament is electrically connected between a second and said third holding wire.

10. Vehicle headlight comprising a lamp according to claim 1 and a reflector.

* * * * *